US007744547B2

(12) United States Patent
Jiang et al.

(10) Patent No.: US 7,744,547 B2
(45) Date of Patent: Jun. 29, 2010

(54) NEGATIVE PRESSURE VENTILATION AND RESUSCITATION SYSTEM

(75) Inventors: Yangdong Jiang, North Reading, MA (US); Robert M. Kacmarek, Littleton, MA (US); Warren M. Zapol, Cambridge, MA (US)

(73) Assignee: The General Hospital Corporation, Boston, MA (US)

( * ) Notice: Subject to any disclaimer, the term of this patent is extended or adjusted under 35 U.S.C. 154(b) by 726 days.

(21) Appl. No.: 10/580,159

(22) PCT Filed: Nov. 29, 2004

(86) PCT No.: PCT/US2004/039888

§ 371 (c)(1),
(2), (4) Date: Jan. 13, 2007

(87) PCT Pub. No.: WO2005/056076

PCT Pub. Date: Jun. 23, 2005

(65) Prior Publication Data

US 2007/0276299 A1 Nov. 29, 2007

(51) Int. Cl.
*A61H 31/00* (2006.01)

(52) U.S. Cl. ..... 601/41; 601/44

(58) Field of Classification Search ..... 601/41, 601/42, 43, 44, 134, 149, 151, 152
See application file for complete search history.

(56) References Cited

U.S. PATENT DOCUMENTS

| | | | | |
|---|---|---|---|---|
| 3,368,550 A | | 2/1968 | Glascock | |
| 4,257,407 A | * | 3/1981 | Macchi | 601/44 |
| 4,621,621 A | | 11/1986 | Marsalis | |
| 5,938,627 A | | 8/1999 | Hickman | |
| 2002/0169399 A1 | | 11/2002 | Rastegar et al. | |
| 2003/0204151 A1 | | 10/2003 | Rastegar et al. | |

FOREIGN PATENT DOCUMENTS

| | | | |
|---|---|---|---|
| GB | 826464 | | 1/1960 |
| GB | 1205200 | * | 9/1970 |

* cited by examiner

*Primary Examiner*—Quang D Thanh
(74) *Attorney, Agent, or Firm*—Nutter, McClennen & Fish, LLP

(57) ABSTRACT

A negative pressure ventilation system comprising a dynamically movable, multi-component artificial rib cage configured to fit snugly around the patient's own chest wall and abdomen is disclosed. The shape, dimensions and the dynamic movement of the artificial rib cage are designed to mimic those of the patient's own chest wall. The artificial rib cage includes an artificial spine to which are connected artificial ribs for forming an artificial chest wall including a sternum component. An abdominal component for placement on the patient's abdomen is connected to the chest wall component through a translating element which allows the abdominal component to move towards and away from the chest wall component. The chest wall and abdominal components cooperatively interact to allow the ventilator to move both the chest wall and abdomen during inspiration and expiration, mimicking the patient's own natural breathing pattern.

21 Claims, 6 Drawing Sheets

NEGATIVE PRESSURE VENTILATION AND RESUSCITATION SYSTEM

FIELD OF THE INVENTION

The present invention relates to respiratory assist devices, and more particularly to a ventilator system for assisting breathing in patients experiencing respiratory distress or respiratory failure. Even more specifically, the present invention relates to a negative pressure ventilator system with an artificial rib cage that can be driven to mimic the patient's own natural breathing pattern.

BACKGROUND OF THE INVENTION

Patients experiencing respiratory failure often require assisted ventilation from external devices or systems to facilitate ventilation (i.e., exchange of respiratory gases) and lung expansion and thereby prevent lung collapse. One known manner for facilitating breathing in these patients is to intermittently apply negative pressure around the chest wall, creating a negative pressure in the lungs and generating inward flow of air and/or other respiratory gases into the lungs. The energy stored in the lungs and the chest wall during inspiration is utilized to move respiratory gases out of the respiratory system as the lungs and chest wall recoil during expiration. The concept of negative pressure ventilation has been known since 1670, when John Mayow first introduced a prototype of a negative pressure ventilator. The prototype consisted of a box within which a patient could sit. Attached to the box was a bladder and bellows for moving air into and out of the box. The mouth of the bladder was sealed around the patient's neck to form a closed system. Thus, movement of the bellows created a negative pressure around the patient, helping to move air into and out of the patient's lungs.

Over the years, several other ventilator models were subsequently developed based on Mayow's principle of negative pressure ventilation. In the early 1930's, the Drinker "Iron Lung" model gained wide popularity and was considered at the time to represent the state of the art for ventilation technology. By 1992, several improved portable iron lung models had been developed and manufactured. Commonly referred to as the Spencer-DHB iron lungs, these new negative pressure ventilators proved to be difficult to use due to their enormous size and weight. Prior to the 1980's, all negative pressure ventilators controlled the patient's ventilatory pattern. By the 1980's, the Emerson Company had developed a ventilator which provided assisted negative pressure ventilation. This allowed the generation of negative pressure to be coordinated with a patient's inspiratory effects, which greatly improved patient comfort and synchrony with the negative pressure ventilator. At the same time, interest in negative pressure ventilators diminished after Dominic Robert of France introduced the concept of noninvasive positive pressure ventilation via a nasal mask in the early 1980's. Robert's approach allowed assisted ventilator support with small, lightweight, portable ventilators, a significant improvement over the negative pressure ventilators available at the time.

Since Robert, noninvasive positive pressure ventilation has become increasingly popular for the provision of ventilatory support for patients with either acute or chronic ventilatory failure. The wide acceptance of noninvasive positive pressure ventilation is based in part on the many conveniences this type of ventilation offers: small size (requiring only a small dedicated floor space) simplicity of operation, and easy physical access to the patient, thereby allowing closer attention to wounds, pressure points, various catheters, intravenous injections, and bedclothes. Yet despite these benefits, noninvasive positive pressure ventilators suffer from several drawbacks. For example, noninvasive positive pressure ventilation prevents the patient from easily communicating, results in facial and oral sores, makes eating difficult, and can cause gastric distention. Although tolerated by many patients, this ventilatory approach is liked by few.

In contrast, whole body negative pressure ventilation is vastly superior in patient comfort. Whole body negative pressure ventilators allow the patient to communicate verbally and do not require sedation either to apply the ventilator itself or during its operation. Patients ventilated with these devices do not "fight" ventilatory support. Furthermore, the machine with its large capacity readily and comfortably overrides asynchronous respiratory efforts. Most importantly, negative pressure ventilation provides physiological advantages over noninvasive positive pressure ventilation. Whole body negative pressure ventilation improves the patient's cardiac output rather than reducing it, as occurs with positive pressure ventilation. During negative pressure ventilation, mean intrathoracic pressure is decreased and venous return is facilitated. Whole body negative pressure ventilation also improves the matching of the patient's ventilation and perfusion, since gas moves into the lungs in a pattern similar to the patient's natural unassisted spontaneous breathing pattern. More importantly, as compared with positive pressure ventilation, negative pressure ventilation is better able to facilitate clearance of airway secretions, avoiding repetitive airway suctioning and bronchoscopy as well as tracheal intubation, thereby avoiding the hazards of bacterial superinfection.

Currently available negative pressure ventilation systems have been hampered by their large size and weight, lack of physical access to patients by caregivers, and limited patient comfort. The portable negative pressure ventilators presently available are not as efficient as whole body ventilator. They are difficult for the patient to attach, air leakage is very common about the seals at the neck, arms, and hips, and they cause air to be drawn across the patient's body, leading to an undesired cooling effect. These portable negative pressure ventilators also prevent patient mobility and are uncomfortable for the user. There is thus a need for a refined negative pressure ventilation system that is smaller in size, lighter in weight, easier to operate for both the caregiver and the patient, and more comfortable for the patient than currently available systems. Also desirable is a negative pressure ventilator that has more automated features to vary the breathing pattern.

SUMMARY OF THE INVENTION

The present invention provides an improved negative pressure ventilation system comprising a dynamically movable, multi-component artificial rib cage configured to fit snugly around the patient's own chest wall and abdomen. The artificial rib cage provides a structural support for the patient's own chest wall, and comprises flexible strut components to effect the movement of the patient's chest. The shape, dimensions and the dynamic movement of the artificial rib cage can be designed to mimic those of the patient's own chest wall. The artificial rib cage includes a chest wall component comprising an artificial spine to which are connected artificial ribs. An abdominal component for placement on the patient's abdomen is connected to the chest wall component through a translating element which allows the abdominal component to move towards and away from the chest wall component. The chest wall and abdominal components cooperatively interact to allow the ventilator to move both the chest wall and abdomen during inspiration and expiration, mimicking the patient's own natural breathing pattern.

In operation, the artificial rib cage is moved by pulling up the anterior portion of the chest wall component of the artificial rib cage and at the same time pulling up the anterior portion of the abdominal component. As this happens, the anterior portion of the chest wall component and the abdominal component move away from the posterior portion of the chest wall component and abdominal component. This movement is achieved by changing the angle between the artificial spine and the artificial ribs of the artificial rib cage. Such movement allows the total size and the weight of the negative pressure ventilating system to be significantly simplified and reduced.

The present negative pressure ventilation system allows the generation of a transitory positive intra-thoracic pressure during the expiratory phase, increasing peak expiratory flow rate, initiating and/or facilitating a cough to help the patient clear airway secretions. An automatic feedback system can be incorporated into the ventilator to allow individual adjustment of the tidal volume, respiratory rate, and inspiratory: expiratory ratio (I:E ratio), allowing synchronization with the patient's spontaneous breathing. In addition, measured end tidal $CO_2$ can be used to automatically adjust the tidal volume, respiratory rate or both.

The system can also provide more efficient cardiopulmonary compression. When a patient's blood circulation is inadequate, for example during cardiac arrest, a very important component of the resuscitation process is chest compression. Pressing and relieving the chest wall creates alternative positive and negative intra-thoracic pressure which, in turn with cardiac valve action, translates into an increased and then decreased intra-ventricular pressure to generate a forward blood flow. However, when the chest is pressed, the amplitude of the intra-thoracic pressure elevation is reduced by downward displacement of the diaphragm. When the pressure applied to the chest is removed, the re-coiling force stored in the chest wall during compression creates a negative intra-thoracic pressure which facilitates venous blood return and re-filling of the atria and ventricles. This process is made less efficient due to the upward movement of the diaphragm when the pressure applied to the chest wall is removed. This invention provides coordinated and opposed movement of the artificial rib cage and the abdominal components so that, during CPR, the amplitude of the positive and negative intra-thoracic pressure increases during a cycle of chest compression. Accordingly, the present system will make the resuscitation more efficient during CPR.

BRIEF DESCRIPTION OF THE DRAWINGS

The invention can be more fully understood from the following detailed description taken in conjunction with the accompanying exemplary drawing, in which.

DETAILED DESCRIPTION OF THE INVENTION

Certain exemplary embodiments will now be described to provide an overall understanding of the principles of the structure, function, manufacture, and use of the devices and methods disclosed herein. One or more examples of these embodiments are illustrated in the accompanying drawings. Those of ordinary skill in the art will understand that the devices and methods specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present invention.

Figure 1:
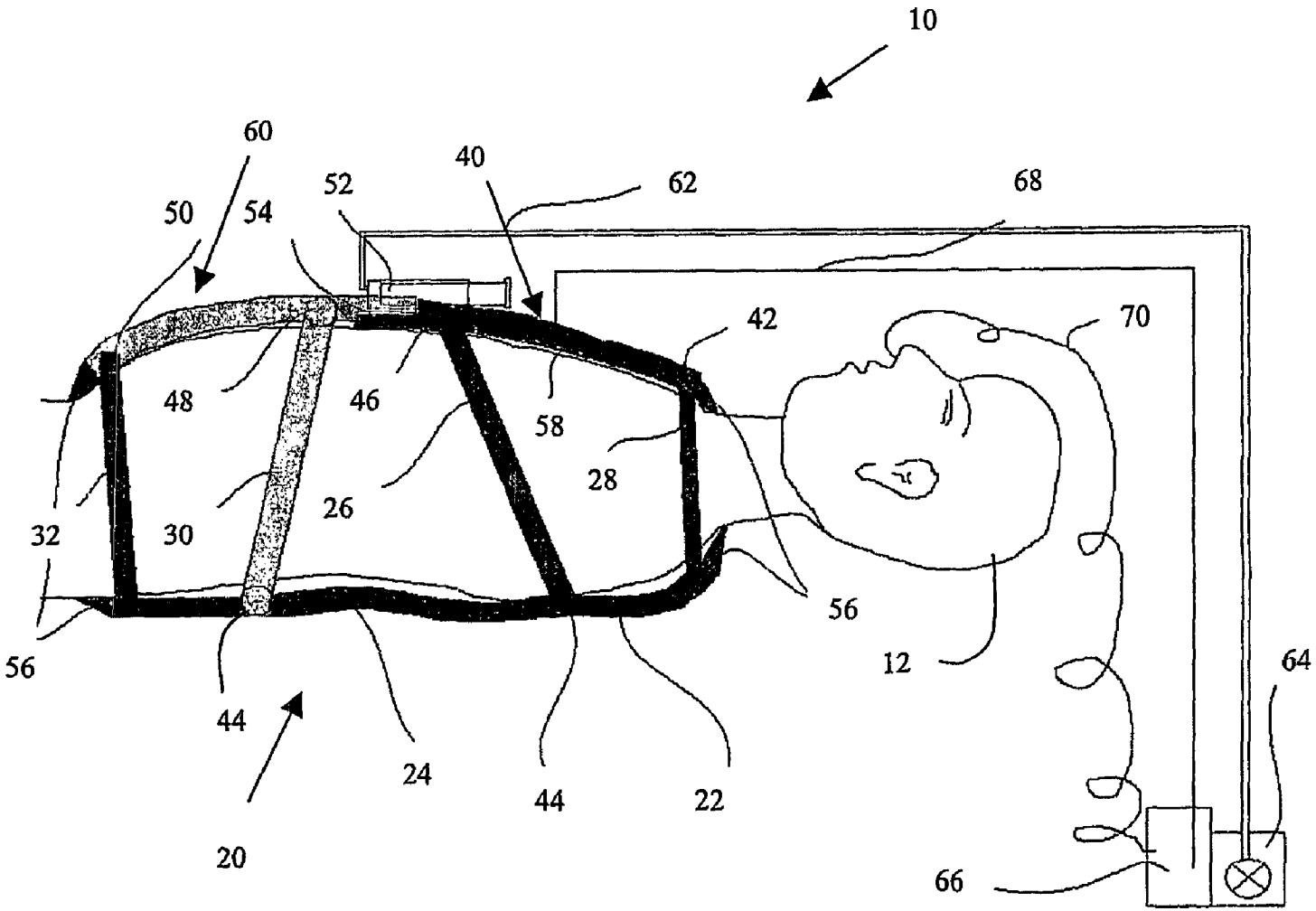
FIG. 1 is a side perspective view of a patient attached to a negative pressure ventilation system of the present invention.

Turning now to the drawings of the present invention and particularly to FIG. 1, a negative pressure ventilation system 10, as applied on a patient 12, is shown. The system 10 includes a dynamic, moveable artificial rib cage (ARC) 20 comprising a spine element 22 to which rib elements 26, 28, 30, 32 are adjustably attached. A joint 24 in the spine allows the patient to bend his own spine to a certain degree. A first, superior-most, rib element 28 and an adjacent rib element 26 are attached to a sternum component 40 configured to rest against the patient's own sternum to form an artificial chest wall. In an exemplary embodiment, first rib element 28 is rigidly attached to the spine element 22 but is pivotally connected to the sternum component 40 by joint 42. In the same embodiment, rib element 26 is pivotally connected to the spine element 22 by joint 44 and to the sternum component 40 by joint 46, and rib elements 30 and 32 are pivotally attached to an abdomen component 60 by joints 48 and 50, respectively. The abdomen component 60 is configured to rest against the patient's abdominal cavity. Similar to the first rib element 28, inferior-most rib element 32 is rigidly attached to the spine element 22 as shown. Collectively, the spine element 22, rib elements 26, 28, 30, 32, sternum component 40, and abdomen component 60 form the artificial rib cage 20 of the present invention.

The movement of the artificial rib cage 20, can be effected, in one embodiment, by translatably attaching the abdomen component 60 to the sternum component 40. As shown in one exemplary embodiment, the abdomen component 60 connects to the sternum component 40 through a translating element 52 such as a piston and cylinder which allows the abdomen component 60 and the sternum component 40 to slide along joint 54 with respect to one another. Seals 56 such as collar rings located along the sternum component 40 for sealing around the patient's neck and located along the abdominal component 60 for sealing around the patient's lower trunk, along with seals (not shown) for the arms of the patient 12, form a closed system between the patient's trunk and the artificial rib cage 20. Thus, as the sternum component 40 and the abdomen component 60 slide with respect to one another, the interconnected rib elements 26, 28, 30, 32 and spine element 22 adjust with each respiratory movement, thereby changing the cross-sectional dimensions of the artificial chest wall. As the cross-sectional dimensions change, alterations of transthoracic pressure are created within the artificial rib cage 20. That is, increases or decreases in the cross-sectional dimensions of the artificial chest wall cause increases or decreases in pressure between the artificial chest wall and the patient's trunk (i.e., chest and abdomen). By including a bias negative intra-rib pressure at end of expiration, the equivalent expansion of positive end expiratory pressure can be added to the ventilation scheme.

In one aspect of the invention, the negative pressure ventilator system 10 is configured to closely conform to the patient's body so that no significant airspace between the system and the patient 12 is present. To prevent irritation, a closed foam spacer may be used to line the abdomen component 60 and/or the sternum component 40. In another aspect, a pressure sensor 58 for sensing the intra-artificial rib cage pressure can be included. As illustrated in FIG. 1, the system 10 can be automated. For example, the translating element 52 or piston and cylinder can be connected to a tube 62 for conducting fluid for powering the piston and cylinder. The tube 62 can be attached to a pump 64 used to pump fluid into and out of the piston and cylinder for movement of the sternum component 40 and abdomen component 60 with respect to one another. The function of the pump 64 is to pump liquid into and out of the piston and cylinder 52. The piston and cylinder slide and move the two components 40, 60 towards and away from each other. This movement changes the angles between the rib elements 26, 28, 30, 32 and the spine element 22 and changes the cross-sectional dimensions of the artificial chest wall. The electric pump 64 can be powered by a battery or wall voltage.

For greater control over the physiological parameters of the system 10, a control panel 66 can be included for monitoring physiological measurements and controlling the operation of the system 10. As shown, the control panel 66 can be connected to a wire 68 conducting the signal from the pressure sensor 58, and can also be connected to a sampling tube 70 which attaches to the patient's nasal cavity for obtaining end tidal $CO_2$ measurements, or a thermistor to sense gas flow. Through the control panel, the pump 64 can be controlled and the following parameters are set: respiratory rate, tidal volume, I:E ratio, and lung volume (residual). For example, the patient's own respiratory effort is sensed as an increase in pressure via the pressure sensor 58. The signal is sent to the control panel 66, triggering a respiratory cycle. If there is no patient respiratory effort, a basic backup rate (e.g., 12 breaths/minute) can be established. Accordingly, automatic feed back of systemic oxygenation can be used to control the bias of negative intrathoracic pressure.

In another embodiment, the translatable element 52 or piston and cylinder could be attached to the spine element 22 and one of the rib elements 26, 28, 30, 32. In this configuration, the piston can slide in and out of the cylinder, causing a change in the angle between the rib elements 26, 28, 30, 32 and the spine element 22, which in turn leads to changes in the cross-sectional dimensions of the artificial chest wall.

Figure 2:
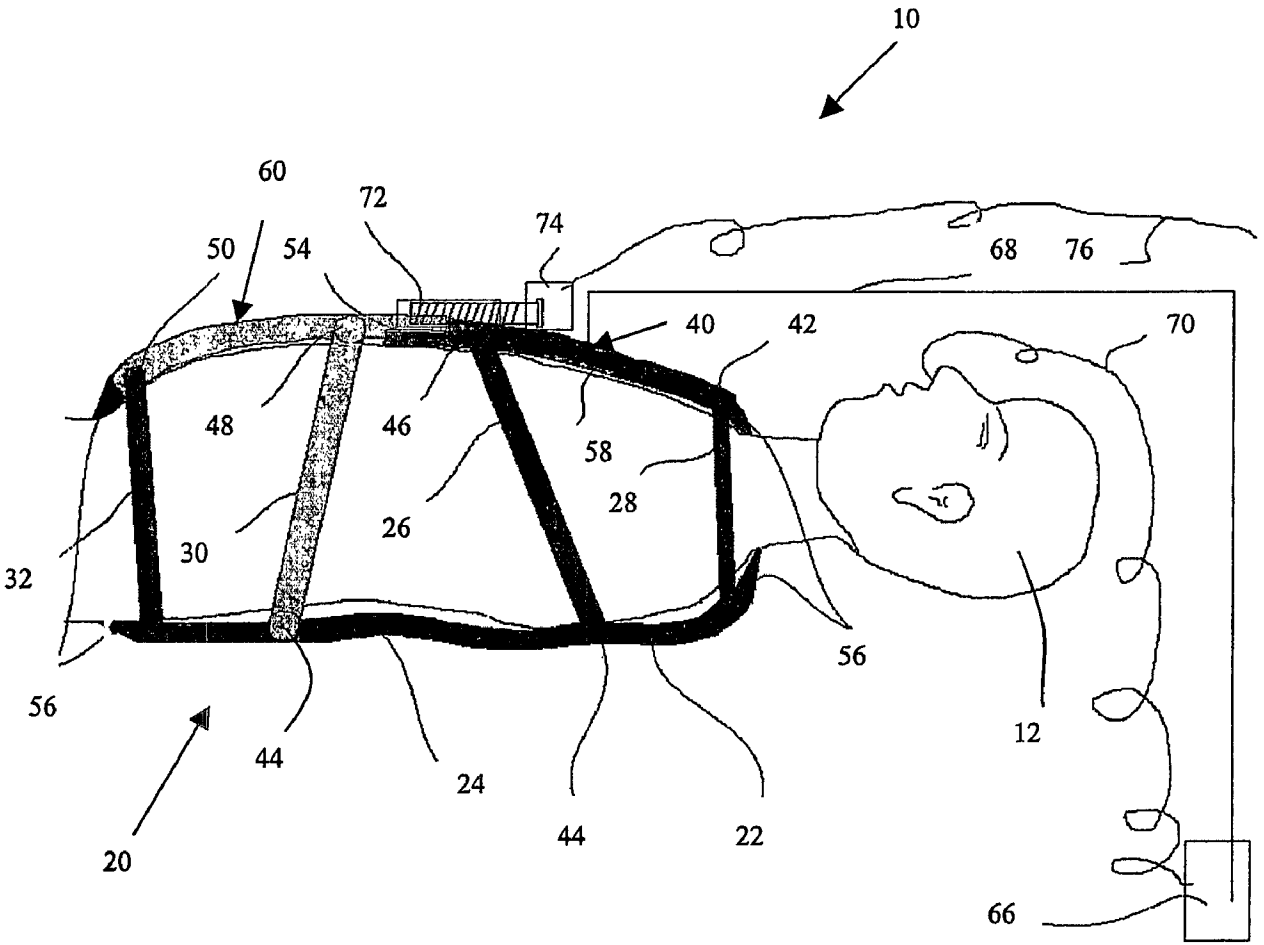
FIG. 2 is a side perspective view of a patient attached to another embodiment of a negative pressure ventilation system of the present invention.

In another embodiment, a motor 72 can be directly attached on the sternum component 40 as shown in FIG. 2. The motor 72 can comprise a screw-like lever to power the movement of the sternum component 40 with respect to the abdomen component 60. When the motor 72 turns in one direction, it pushes the sternum component 40 and the abdomen component 60 away from each other; when the motor 72 is turned in the other direction, it pulls the two components 40, 60 towards to each other. The motor 72 can be attached to a power supply 74 which receives voltage from power cable 76. The power supply 74 directs the motor 72 to turn in either one of two directions to power the screw-like lever.

Figure 3B:
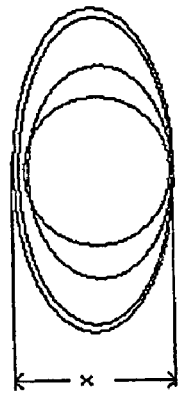
FIG. 3B is a cross-sectional view of the artificial rib cage of FIG. 3A along lines B-B.
Figure 3D:
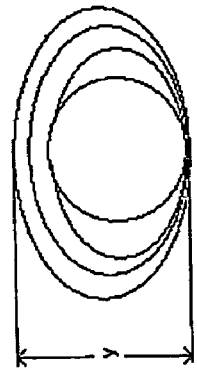
FIG. 3D is a cross-sectional view of the artificial rib cage of FIG. 3C along lines D-D.
Figure 3A:
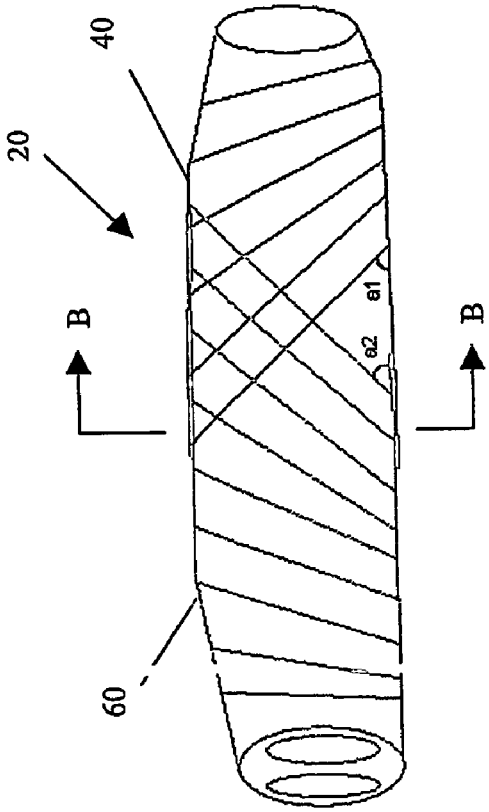
FIG. 3A is a lateral view of the artificial rib cage of the present invention at the end of expiration.
Figure 3C:
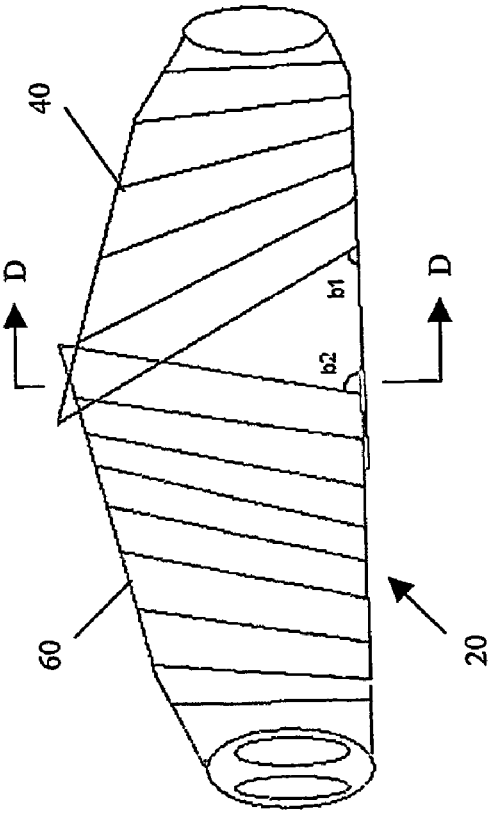
FIG. 3C is a lateral view of the artificial rib cage of the present invention at the end of inspiration.

FIGS. 3A through 3D illustrate the basic shape-changing dynamics of the artificial rib cage 20 that form as aspect of the present system. As previously mentioned, the shape of the artificial chest wall is similar to that of the patient's natural thorax. FIG. 3A shows a lateral view of the artificial rib cage 20 at the end of expiration, with the sternum component 40 and the abdominal component 60 overlapping. FIG. 3B shows the cross-section of the artificial rib cage 20 along lines B-B. During inspiration, the two components 40 and 60 slide away from one another, enlarging the angle between the rib elements 26, 28, 30, 32 and the spine element 22, as shown in FIG. 3C. Therefore b1>a1 and b2>a2, and the cross-section of both the components 40 and 60 are enlarged (i.e., Y>X), as shown in FIG. 3D.

As illustrated in FIGS. 3A through 3D, the change in the cross-sectional dimensions of the artificial chest wall are greatest at the diaphragmatic level and smallest at the first rib 28, while the shape of the abdominal component 60 is made similar to that of the patient's own abdomen. Accordingly, the artificial chest wall mimics the patient's own rib cage. Increases in the angle (a1) between the spine element 22 and the rib elements 26, 28 cause an increase in the cross-sectional dimensions during the inspiratory phase. The same principle applies to the abdominal component 60, but the angle (a2) between the rib elements 30, 32 and the spine element 22 faces in the opposite direction. Change in the cross-sectional dimensions of the abdominal component 60 is greatest at the diaphragmatic level and smallest at rib element 32 during the respiratory cycle. These dynamics allow the patient's own chest wall to move in a manner similar to that which occurs during natural spontaneous breathing.

Figure 4:
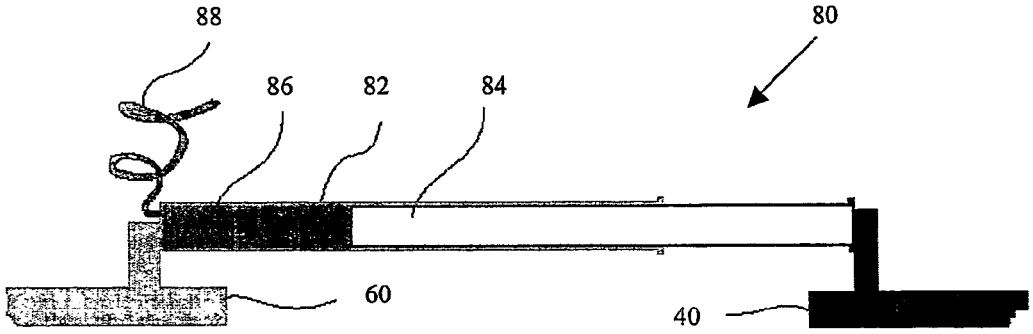
FIG. 4 is a side perspective view of a cylinder and piston system of the present invention.

In operation, the sternum component 40 and the abdomen component 60 meet and overlap each other at the anterior diaphragmatic level. These two components 40, 60 are moved towards and away from each other with the assistance of a translatable element 52 that allows the components 40, 60 to slide relative to one another. This sliding movement can be powered by a piston and cylinder system 80 as illustrated in FIG. 4. When liquid 86 is pumped into the cylinder 84, it pushes the piston 82 out of the cylinder 84. This movement results in the sternum component 40 sliding away from the abdomen component 60, since the cylinder 84 is fixed on the sternum component 40 while the piston 82 is fixedly attached to the abdomen component 60. When the liquid is removed from the cylinder 84, the sternum and abdomen components 40, 60 move toward each other. Relative movement of the these two components 40, 60 results in a change in the angle between the spine element 22 and the rib elements 26, 28, 30, 32, which in turn changes the volume of the artificial chest wall and patient's lung volume.

Figures 5A, 5B:
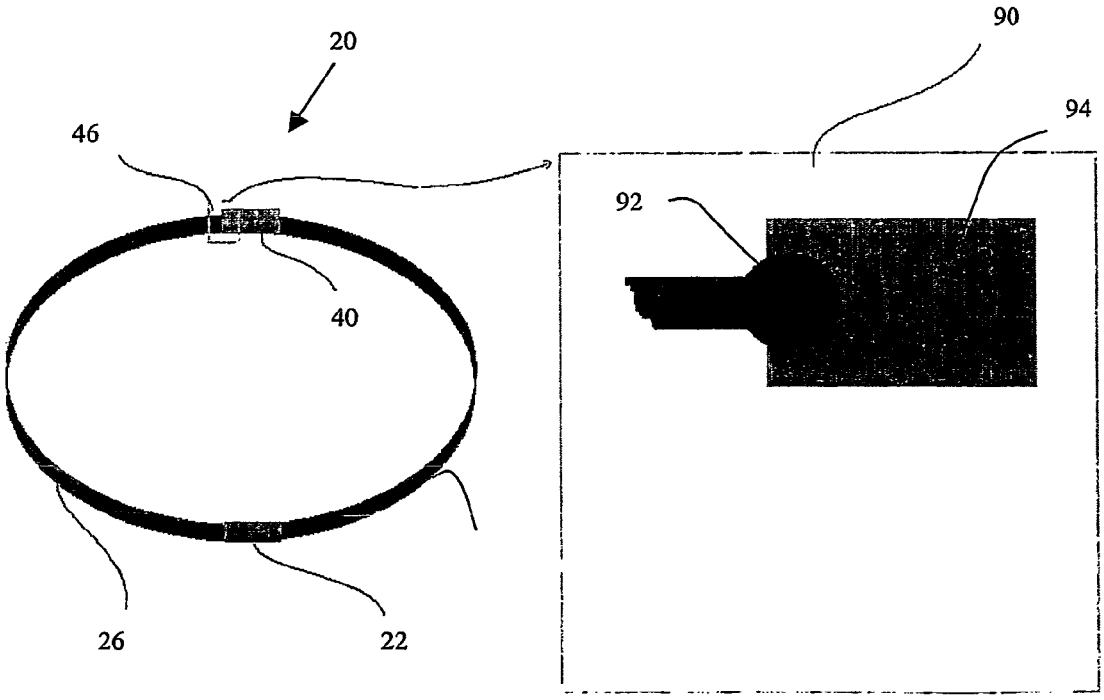
FIG. 5A is a cross-sectional view of the artificial rib cage of the present invention.
FIG. 5B is an enlarged view of a ball and socket joint of FIG. 5A.

To allow movement of the rib elements 28, 30 and the spine element 22, a ball and socket joint 90, such as the one shown in FIGS. 5A and 5B, can be used at joints 44 to connect the rib elements 28, 30 to the spine element 22. Likewise, to allow movement of the rib elements 26, 28, 30, 32 relative to the sternum and abdomen components 40, 60, ball and socket joints 90 can be used at joints 42, 46, 48 to connect the rib elements 26, 28, 30, 32 to the sternum and abdomen components 40, 60. In the illustrated embodiment there is no joint between the first rib element 28 and the spine element 22, or between rib element 32 and the spine element 22. As illustrated in FIG. 5A, rib elements 26 attached to spine element 22 are connected to sternum element 40 at joint 46, shown enlarged as ball and socket joint 90 in FIG. 5B, where the rib element 26 includes at the terminal end a ball connector 92 for rotatable and pivotal movement within a spherical socket 94 of the sternum component 40 configured to hold the ball connector 92. The rib elements 26 are similarly connected to the spine element 22. It is contemplated that all the joints between the rib elements 26, 28, 30, 32 and the spine element 22 or sternum or abdomen components 40, 60 in the present system 10 can be configured like the ball and socket joint 90 shown.

Figure 6:
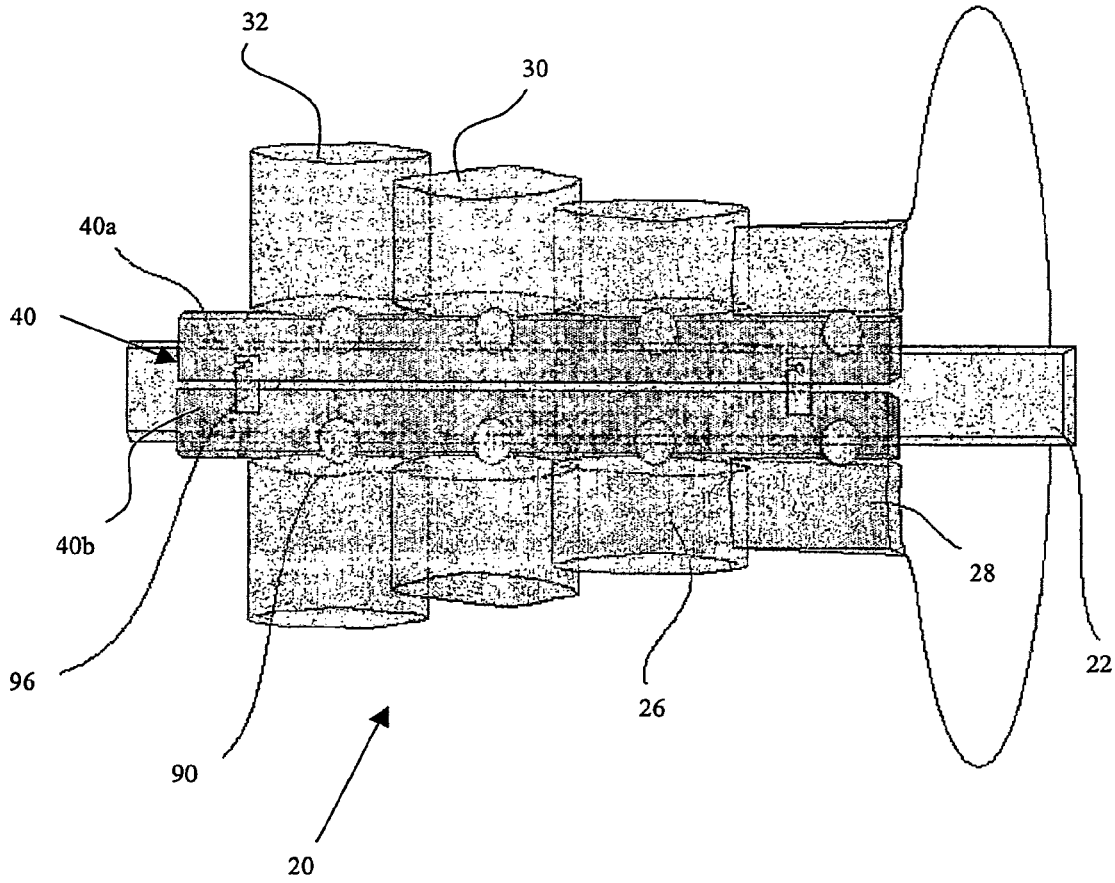
FIG. 6 is a perspective view of the artificial rib cage of the present invention.

A feature of the present system is that the shape of the artificial rib elements 26, 28, 30, 32 mimic the shape of the patient's actual rib cage. As shown in FIG. 6, there can be some overlap between adjacent rib elements. With the present system 10, the length of the rib elements 26, 28, 30, 32 can be adjustable according the size of the patient 12. Once the length of the rib element is chosen, the rib element can be locked and fixed onto the spine element to form a rigid rib (not shown). The sternum component 40 can be formed as two separate components, 40*a* and 40*b*, as illustrated, to allow the patient 12 to fit inside the artificial rib cage 20. Prior to placement on the patient 12, the two halves 40*a*, 40*b* of the sternum component can be opened up, though the halves 40*a*, 40*b* are still connected to the spine element 22 by the rib elements 26, 28, 30, 32. This feature allows the artificial rib cage 20 to be placed onto the patient 12 without difficulty. Once the artificial rib cage 20 is placed onto the patient 12, the two halves 40*a*, 40*b* of the sternum component 40 can be locked and fixed together such as with lock 96 to form one component.

Figure 7A:
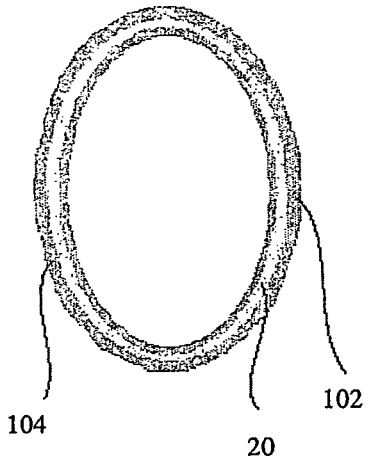
FIG. 7A is a cross-sectional view of the negative pressure ventilation jacket of FIG. 7B along lines A-A.
Figure 7B:
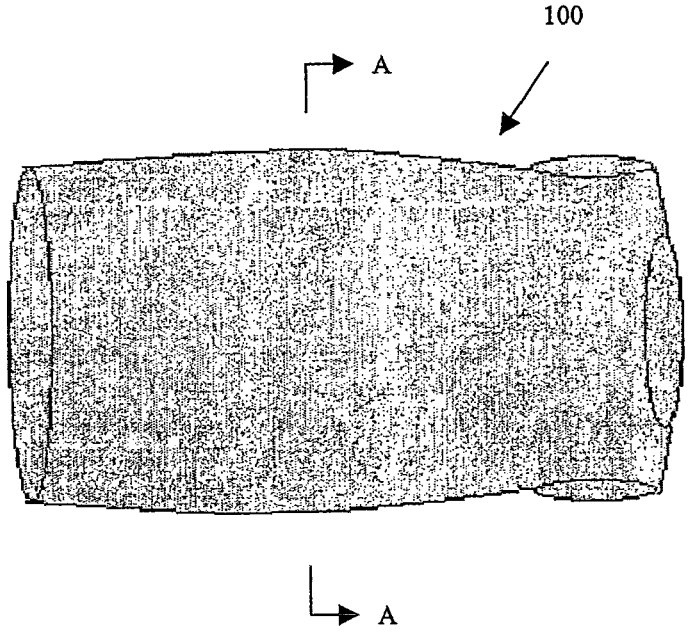
FIG. 7B is a perspective view of a negative pressure ventilation jacket of the present invention.

In another aspect of the invention, the artificial rib cage 20 can include a cover 102 and lining 104 composed of a thin plastic sheet with some elasticity to provide an airtight system 10, as shown in FIGS. 7A and 7B. It is contemplated that the lined and covered artificial rib cage 20 can form a negative pressure ventilation jacket 100 for placement around the patient's chest wall and lower trunk. The jacket 100 would be sealed at the patient's neck, arms and trunk to create a closed system. Therefore, changing the cross-sectional dimensions of the artificial rib cage 20 leads to changes in the pressure around the patient's chest and abdominal wall.

While described herein as a ventilation system, the present invention can also be used as a resuscitation system. The artificial rib cage 20, together with the abdominal component 60, are designed to carry out chest compression for resuscitation of patients experiencing cardiovascular collapse and/or cardiac arrest. The system 10 can effect more efficient cardiopulmonary compression by providing coordinated and opposed movement of the artificial rib cage and the abdominal components so that, during CPR, the amplitude of the positive and negative intra-thoracic pressure increases during a cycle of chest compression. Accordingly, the present invention will make the resuscitation more efficient during CPR It will be understood that the foregoing is only illustrative of the principles of the invention, and that various modifications can be made by those skilled in the art without departing from the scope and spirit of the invention. All references cited herein are expressly incorporated by reference in their entirety.

What is claimed is:

1. A respiratory assist system, comprising:

an artificial rib cage configured to fit sealingly over a patient's chest wall and abdomen to form a closed system, the artificial rib cage comprising a spine element, a plurality of rib elements connected to the spine element, a sternum component configured for placement against a patient's chest, and an abdomen component configured for placement against a patient's abdomen, the sternum component and abdomen component being attached to the rib elements;

wherein the sternum component and the abdomen component are movably connected to each other with a translating element, such that movement of the sternum component with respect to the abdomen component effects a change in the size and shape of the artificial rib cage to create a negative and positive pressure within the artificial rib cage during a cycle of respiration.

2. The system of claim 1, wherein the translating element is a cylinder and piston assembly.

3. The system of claim 2, wherein the cylinder and piston assembly are fixedly attached to the sternum component and the abdomen component.

4. The system of claim 1, wherein the translating element is a motorized screw lever.

5. The system of claim 1, wherein the artificial rib cage includes a foam liner adapted to be disposed between the artificial rib cage and the patient's chest.

6. The system of claim 1, wherein the abdomen component and the sternum component are slidably movable with respect to one another.

7. The system of claim 1, wherein at least one of the plurality of rib elements is movably connected to the sternum component with a ball and socket joint.

8. The system of claim 1, wherein at least one of the plurality of rib elements is movably connected to the abdomen component with a ball and socket joint.

9. The system of claim 1, wherein at least one of the plurality of rib elements is movably connected to the spine element with a ball and socket joint.

10. The system of claim 1, wherein system further includes an automatic feedback system for adjusting a physiological parameter selected from the group consisting of tidal volume, respiratory rate, and inspiratory to expiratory ratio, including high frequency oscillatory ventilation.

11. The system of claim 1, wherein the system is automated.

12. The system of claim 1, wherein movement of the sternum component with respect to the abdomen component causes a change in the cross-sectional dimensions of the artificial rib cage.

13. The system of claim 1, wherein movement of the sternum component and the abdomen component towards each other decreases the angle between the plurality of rib elements and the spine element.

14. The system of claim 1, wherein movement of the sternum component and the abdomen component away from each other increases the angle between the plurality of rib elements and the spine element.

15. The system of claim 1, wherein the artificial rib cage includes a cover.

16. The system of claim 1, wherein the artificial rib cage includes a liner.

17. The system of claim 1, wherein the artificial rib cage forms a jacket for placement around a patient's chest and lower trunk.

18. The system of claim 1, further being configured to perform chest compressions for resuscitating a patient experiencing cardiovascular collapse or cardiac arrest.

19. The device of claim 1, wherein the spine element has four rib elements attached thereto, and a superior-most rib element and an inferior-most rib element are rigidly attached to the spine component, and a first intermediate rib and a second intermediate rib element are pivotally connected to the rib element by a joint.

20. The device of claim 19, wherein the superior-most rib element is pivotally connected to the sternum component by a joint and the inferior-most rib element is pivotally connected to the abdomen component by a joint.

21. The device of claim 19, wherein one of the intermediate rib elements is movably connected to the sternum by a joint and the other of the intermediate rib elements is movably connected to the abdomen component by a joint.

* * * * *